US005664616A

United States Patent [19]

Gegel

[11] Patent Number: 5,664,616

[45] Date of Patent: Sep. 9, 1997

[54] PROCESS FOR PRESSURE INFILTRATION CASTING AND FUSION BONDING OF A METAL MATRIX COMPOSITE COMPONENT IN A METALLIC ARTICLE

[75] Inventor: Gerald A. Gegel, Morton, Ill.

[73] Assignee: Caterpillar Inc., Peoria, Ill.

[21] Appl. No.: 608,905

[22] Filed: Feb. 29, 1996

[51] Int. Cl.[6] ..... B22D 19/14

[52] U.S. Cl. ..... 164/97; 164/105

[58] Field of Search ..... 164/97, 98, 103, 164/104, 105

[56] References Cited

U.S. PATENT DOCUMENTS

| | | | |
|---|---|---|---|
| 5,004,034 | 4/1991 | Park et al. | 164/97 |
| 5,188,164 | 2/1993 | Kantner et al. | 164/97 |
| 5,322,109 | 6/1994 | Cornie | 164/97 |

*Primary Examiner*—Kuang Y. Lin
*Attorney, Agent, or Firm*—Pankaj M. Khosla

[57] ABSTRACT

A process for pressure infiltration casting of a metal matrix composite in a metallic article is disclosed. A metallic base component is formed. A portion of the exterior surface of the metallic base component is adapted for mating with a corresponding exterior surface of a preform at an interface. A preform having interconnecting porosity is formed. An infiltration metal for forming a molten infiltrant charge and having a melting temperature "y" at least equal to or greater than the melting temperature "x" of the base metal is selected. A first mold including the base component is provided and preheated to a temperature in the range of (x−200)°F. to (x−50)°F. A second mold including the preform and the infiltration metal is provided and positioned adjacent the first mold. The second mold, preform and infiltration metal are heated to a temperature in the range of about (y−200)°F. to about (y+200)°F. The preform is evacuated and a vacuum is isolated in the preform. The molten infiltrant charge is pressurized at a pressure sufficient to infiltrate the molten charge into the interconnecting porosity of the preform and form an infiltrated preform. The infiltration metal is contacted with the base metal at the interface and fusion-bonding of the infiltration metal with the base metal is caused. The metallic base is cooled to cause directional solidification of the infiltration metal.

20 Claims, 2 Drawing Sheets

PROCESS FOR PRESSURE INFILTRATION CASTING AND FUSION BONDING OF A METAL MATRIX COMPOSITE COMPONENT IN A METALLIC ARTICLE

TECHNICAL FIELD

The present invention relates generally to a pressure infiltration casting process, and more particularly to a process for pressure infiltration casting and fusion bonding of a metal matrix composite component in a metallic article.

BACKGROUND ART

It is well known in the earthworking equipment industry that the useful life of a cutting edge or cutting bit of say, a ground engaging component, is increased if it has a combination of both wear and impact resistance. For example, equipment such as excavation teeth, excavation blades, mining plows, grading blades, impact blades and the like, which engage the ground, require both high wear resistance and fracture toughness. But it is also very crucial that the wear and impact component be bonded to the supporting base metal in a manner that the ground engaging tool does not fail due to a failure of the bond between the wear and impact component and the supporting base.

In the past, researchers at Caterpillar Inc., the assignee of the present invention, have developed composite materials having a combination of impact and wear resisting surfaces. One composite material includes a base member of austempered ductile iron and a plurality of hard particles such as tungsten carbide imbedded in the base member. The composite material may be prepared in a variety of ways. One way is to place the tungsten carbide particles into a mold and pour iron metal around them. The metal is solidified by cooling and then austempered. Another way is to place hard inserts made from a hard paste of tungsten carbide on the surfaces of a polystyrene foam pattern. The foam pattern is placed in a sand mold and during casting, the iron replaces the polystyrene and infiltrates the hard particle paste. The iron is solidified and then the composite is austempered.

Other methods developed at Caterpillar Inc. include techniques where abrasion resistant materials are welded on a surface or into cavities in the metal base comprising the ground engaging tool. Although the foregoing techniques have been very successful, there is a desire to continuously improve the wear and impact resistance of such components used for making ground engaging tools in order to enhance quality and maintain a competitive edge in the global marketplace.

There has been a long-felt need for having cast-in-place metal matrix composites that have a combination of abrasion resistance, impact resistance and a high strength bond between the metal matrix surface and the metal base surface. The wear resistance is achieved by increased hardness of the metal matrix composite while high impact strength is attained by increasing the fracture toughness of the, metal matrix composite. However, the bond strength at the metal matrix-base metal interface is typically not high enough for the composite to perform very well in a rigorous environment to which a ground engaging tool is exposed.

Several pressure infiltration casting processes are well known in the industry. U.S. Pat. No. 5,004,034 issued to Park et al. discloses a process for forming a metal matrix composite between at least two bodies having similar or a different chemical composition. The metal matrix composite is produced by a spontaneous infiltration technique by providing a preform with an infiltration enhancer or infiltration atmosphere, which are in communication with the preform at least some point during the process. Molten infiltrating metal or matrix metal then spontaneously infiltrates the preform, whereby the metal matrix composite serves to bond together two or more bodies.

U.S. Pat. No. 5,188,164 issued to Kantner et al. discloses a process for forming a metal matrix composite by the application of a self-generated vacuum infiltration without the application of any external pressure or vacuum.

U.S. Pat. No. 5,322,109 issued to Cornie, and incorporated herein by reference, discloses a method for pressure infiltration casting wherein the steps of preheating and evacuating a mold cavity and infiltrant charge are carried out in a separate vessel from the pressure vessel wherein the mold cavity is filled using a vent tube. This process evidently allows for rapid finished article throughput.

It has been desirable to have an improved pressure infiltration casting process for making articles that have cast-in-place metal matrix composite components that exhibit a combination of wear and impact resistance properties and a high bond strength between the metal matrix and the supporting base metal.

The present invention is directed to overcome one or more problems of heretofore utilized pressure infiltration casting processes used for making articles having cast-in-place metal matrix composites.

DISCLOSURE OF THE INVENTION

In one aspect of the present invention, a process for pressure infiltration casting of a metal matrix composite in a metallic article is disclosed. The process comprises the steps of selecting a base metal for forming a metallic base component. The base metal has a melting temperature. The metallic base component having a shape of preselected dimensions and an exterior surface of a preselected configuration is formed. At least a portion of the exterior surface of the metallic base component is adapted for mating with a corresponding exterior surface of a preform.

A material for forming the preform is selected. The material is selected from one of ceramics, cermets, metals, refractories, or mixtures thereof. The preform having an exterior surface of a preselected configuration is formed. At least a portion of the exterior surface of the preform is adapted for mating with the corresponding exterior surface of the metallic base. The preform has interconnecting porosity.

An infiltration metal for forming a molten infiltrant charge is selected. The infiltration metal has a melting temperature at least equal to or greater than the melting temperature of the base metal.

A first mold having a first mold cavity is provided. The first mold includes the metallic base component. The first mold and the metallic base component are preheated to a temperature in the range of about (x−200)°F. to about (x−50)°F., wherein x is the melting temperature of the base metal.

A second mold having a second mold cavity is also provided. The second mold includes the preform and the infiltration metal.

The second mold is positioned adjacent the first mold and a portion of the exterior surface of the preform is mated with a corresponding exterior surface of the metallic base to form an interface.

The second mold, the preform and the infiltration metal are heated to a temperature in the range of about (y−200)°F.

to about (y+200)°F., wherein y is the melting temperature of the infiltration metal. A preheated preform and the molten infiltrant charge are thus formed.

The preform is evacuated and a vacuum is isolated in the preform. The molten infiltrant charge is pressurized at a pressure sufficient for infiltrating the molten charge into the interconnecting porosity of the preform to form an infiltrated preform. The molten infiltration charge is contacted with the preheated base metal at the interface. A portion of the base metal is melted at the interface. Fusion-bonding of the infiltration metal with the base metal is caused at the interface to form a fusion bond interface.

The metallic base is then cooled and directional solidification of the infiltration metal from the fusion bond interface to the exterior surface of the preform is caused.

BEST MODE FOR CARRYING OUT THE INVENTION

Figure 1:
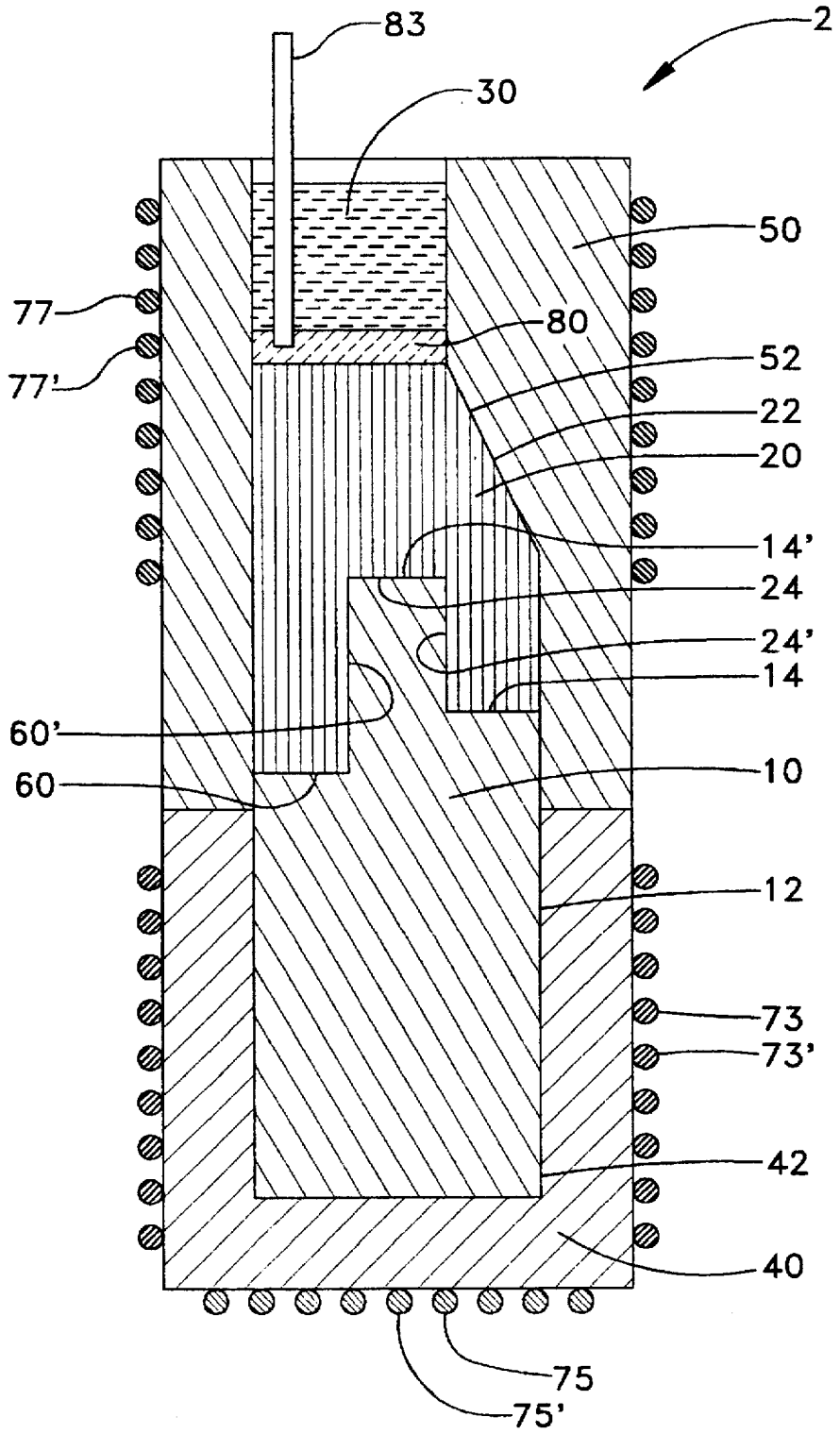
FIG. 1 is a schematic illustration in a cross section side view of an apparatus for carrying out a portion of the process steps, according to the preferred embodiment of the present invention.

Referring to FIG. 1, an apparatus 2 for carrying out a process for pressure infiltration casting of a metal matrix composite in a metallic article is disclosed. The process comprises the steps of selecting a base metal for forming a metallic base component. The base metal has a melting temperature. The metallic base component 10 having a shape of preselected dimensions and an exterior surface 12 of a preselected configuration is formed. At least a portion 14,14' of the exterior surface of the metallic base component 10 is adapted for mating with a corresponding exterior surface 24,24' of a preform.

A material for forming the preform is selected. The material is selected from one of ceramics, cermets, or mixtures thereof. The preform 20 having an exterior surface 22 of a preselected configuration is formed. At least a portion 24,24' of the exterior surface of the preform is adapted for mating with the corresponding exterior surface 14, 14' of the metallic base 10. The preform 20 has interconnecting porosity.

An infiltration metal for forming a molten infiltrant charge 30 is selected. The infiltration metal has a melting temperature at least equal to or greater than the melting temperature of the base metal.

A first mold 40 having a first mold cavity 42 is provided. The first mold 40 includes the metallic base component 10. The first mold 40 and the metallic base component 10 are preheated by means 73,73' to a temperature in the range of about (x−200)°F. to about (x−50)°F., wherein x is the melting temperature of the base metal.

A second mold 50 having a second mold cavity 52 is also provided. The second mold 50 includes the preform 20 and the infiltration metal 30.

The second mold 50 is positioned adjacent the first mold 40 and a portion of the exterior surface of the preform 20 is mated with a corresponding exterior surface of the metallic base 10 to form an interface 60,60'.

The second mold 50, the preform 20 and the infiltration metal 30 are heated by heating means 77,77' to a temperature in the range of about (y−200)°F. to about (y+200)°F., wherein y is the melting temperature of the infiltration metal. A preheated preform and the molten infiltrant charge are thus formed. Alternatively, the infiltrant metal may be melted in a separate chamber by heating the infiltrant metal to a temperature in the range of about (y−200)°F. to about (y+200)°F., and then poured into the second mold.

The preform is evacuated and a vacuum is isolated in the preform by means 83. Means 83 is a metal tube or conduit which is connected to a vacuum pump, not shown in the drawing. After isolating a vacuum in the preform, the tube 83 is sealed off. Such vacuum generation and isoiation techniques are well known to those skilled in the art and will therefore not be discussed in detail here.

Figure 2:
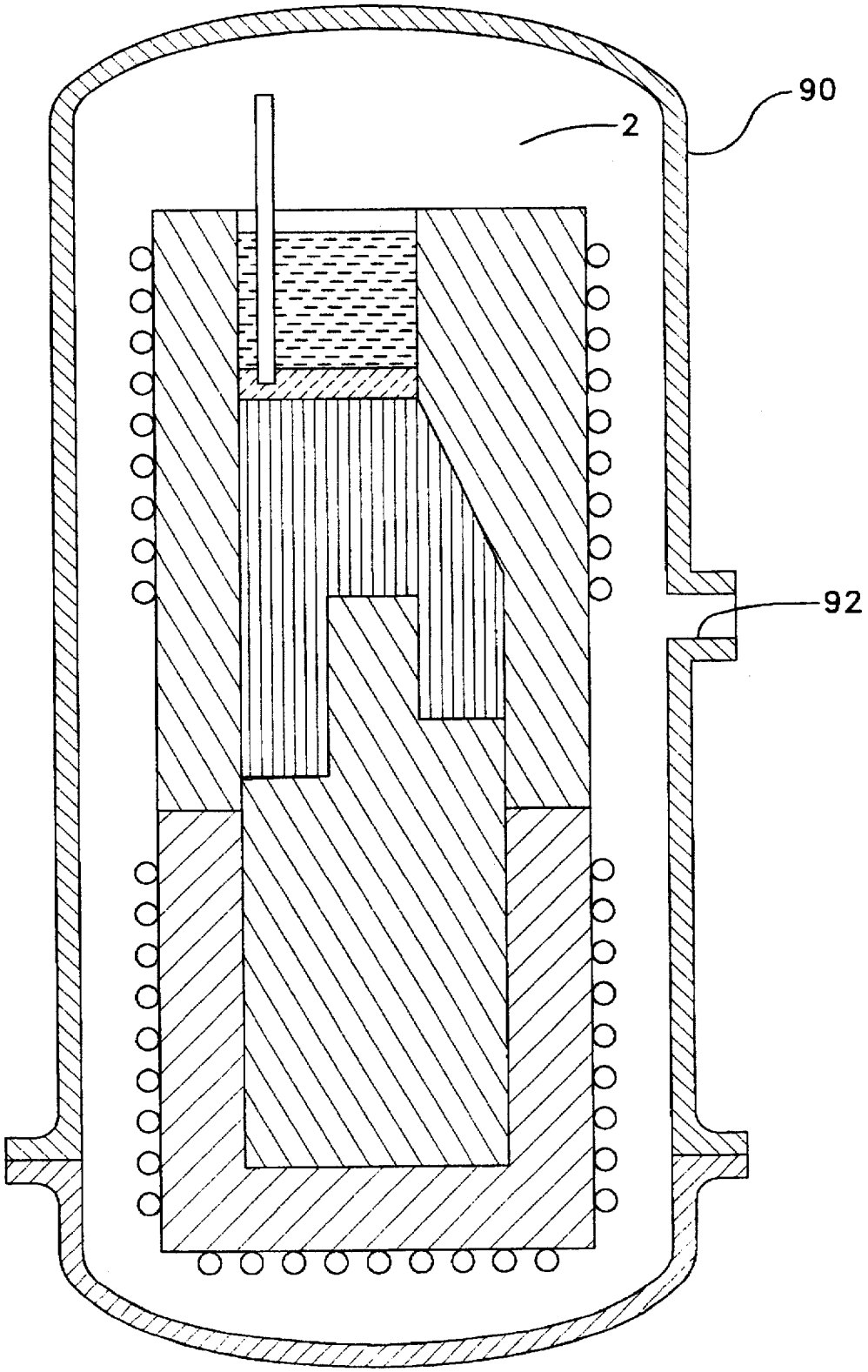
FIG. 2 is another schematic illustration in a cross section side view of an apparatus for carrying out the rest of the process steps, according to the preferred embodiment of the present invention.

Referring to FIG. 2, shows the apparatus of FIG. 1 inside a pressure chamber 90 having an opening 92 for pressurizing. The molten infiltrant charge is pressurized at a pressure sufficient for infiltrating the molten charge into the interconnecting porosity of the preform 20 to form an infiltrated preform. The molten infiltration charge is contacted with the preheated base metal at the interface 60,60'. A portion of the base metal is melted at the interface 60,60'. Fusion-bonding of the infiltration metal with the base metal is caused at the interface to form a fusion bond interface.

The metallic base is then cooled by means 75,75' and directional solidification of the infiltration metal from the fusion bond interface to the exterior surface of the preform is caused. Directional solidification allows the fusion bond interface to solidify first and then the rest of the infiltrated preform is solidified.

Preheating means 73,73', and heating means 77,77' include electrical heating elements Which can be wrapped around or embedded in the mold. Alternatively, other heating means using heat transfer fluids flowing through fluid channels in the molds may be employed. Cooling means 75,75' include heat transfer fluids flowing through fluid channels in the mold. Such heating and cooling means are well known to those skilled in the art.

As used in this description and in the claims, the term "preform" refers to a porous body which can include fibers, whiskers, particulates and a porous pack which acts as a reinforcement phase which can be subsequently infiltrated by a metal to form a infiltrated preform.

As used herein, the term "infiltration" refers to the injection under pressure of a molten liquid. The molten infiltrate charge which can be a molten metal, a metal alloy or an intermetallic compound infiltrates into the preform under pressure.

The term "bonded" as used herein means any method of attachment between two bodies. The attachment may be physical, and/or chemical and/or mechanical. A physical attachment requires that at least one of the two bodies, usually in a liquid state, infiltrate at least a portion of the microstructure of the other body. This phenomenon is commonly known as "wetting". A chemical attachment requires that at least one of the two bodies chemically react with the other body to form at least one chemical bond between the two bodies. A mechanical attachment between two bodies includes a macroscopic infiltration of at least one of the two bodies into the interior of the other body. One example of mechanical attachment would be the infiltration of at least one of the two bodies into a groove or a slot on the surface of the other body. Such mechanical attachment does not include microscopic infiltration or wetting.

The term "fusion-bonding", as used herein, means a chemical attachment between the two bodies. This attachment occurs when the two bodies chemically react with each other and the two bodies are in a semi-molten state, especially at the interface, such that there is a weld formation at the interface where one body meets the other. The term "fusion bonding" as used herein does not mean physical and/or mechanical attachment but is rather a form of chemical bonding.

The term "metal matrix composite", as used herein, means a porous reinforcement preform used to form a metal matrix composite body wherein the porous reinforcement preform is infiltrated by an infiltration metal. The metal matrix composite has two or more physically and/or chemically distinct, suitably arranged or distributed components, and exhibits improved property characteristics that are not exhibited by any of the components in isolation. For example, a metallic component is reinforced by a ceramic or cermet component to form a metal matrix composite.

The term "interconnecting porosity", as used herein, means that the preform has a porous structure and the pores do not exist in isolation but rather, they are connected to one another to form interconnecting porous channels. These channels facilitate the infiltration of the infiltration metal into the preform.

The term "cermet" as used herein, describes a type of material that includes a ceramic component and a metal component. Examples of cermets include metal and ceramic carbides, such as for example, tungsten carbide, titanium carbide and cobalt.

In the preferred embodiment of the present invention, the base metal is one of cast iron or alloy steel. Preferably, the base metal base is an alloy steel. The alloy steel, in one embodiment, has a composition by weight percent comprising 0.22 to 0.29 carbon, 1.2 to 1.5 manganese no greater than 0.04 phosphorous and no greater 0.05 sulfur and balance iron. The alloy steel, in another embodiment, has a composition by weight percent comprising 0.36 to 0.44 carbon, 0.7 to 1.00 manganese, 0.15 to 0.3 silicon, 0.8 to 1.15 chromium, 0.15 to 0.25 molybdenum, no greater than 0.035 phosphorous, no greater than 0.04 sulfur and balance iron.

In the preferred embodiment of the present invention, the metal matrix composite is bonded to the metallic base component by at least a chemical bond. Desirably, the metal matrix composite is bonded to the metallic base component by a combination of a chemical bond and one of physical bond, mechanical bonds, or a combination thereof. A physical bond is attained by partial encapsulation, of the metal matrix composite by the metal base component by a pressure infiltration process as described hereunder.

In the preferred embodiment of the present invention, the preform has a configuration of one of a porous pack, particulates, tubules platelets, pellets, spheres, fibers, a woven mat, whiskers and mixtures thereof. Preferably, the preform has a configuration of particulates.

In the preferred embodiment of the present invention, the preform is formed from aluminum oxide particulates having a particle size in the range of to 30 mesh. A particle size larger than 20 mesh size is undesirable because the packing density would be too low and the desired total porosity of the wear resistant preform will not be attained within the range of about 40% to about 60%. A particle size smaller than 30 mesh is undesirable because the packing density would be too high and the desired total porosity of the wear resistant preform will be less than about 40%. This will detrimentally reduce wear resistance of the resultant metal matrix composite.

In the preferred embodiment of the present invention, the ceramic material is at least one ceramic material desirably selected from the group consisting of titanium carbide, aluminum oxide, titanium diboride and tungsten carbide. Preferably, the ceramic material is aluminum oxide.

Alternatively, the preform may also be made from ceramic materials selected from yttrium oxide, boron nitride, zirconium carbide, hafnium carbide, zirconium nitride, hafnium nitride, and diamond particulates.

In the preferred embodiment of the present invention, the cermet material is at least one cermet material desirably formed from (a) ceramic materials selected from the group consisting of titanium carbide, chromium carbide, titanium diboride and tungsten carbide, and (b) metallic materials selected from the group consisting of molybdenum, cobalt, tungsten, chromium, niobium and tantalum, or mixtures thereof. Preferably, the cermet is tungsten carbide and cobalt.

In the preferred embodiment of the present invention, the infiltration metal is desirably at least one of molybdenum, tungsten, chromium, niobium, tantalum, iron, alloy steel or mixtures thereof, and preferably, one of iron or alloy steel or mixtures thereof. In the preferred embodiment, the infiltration metal is an alloy steel, having a composition by weight percent comprising 0.36 to 0.44 carbon, 0.7 to 1.00 manganese, 0.15 to 0.3 silicon, 0.8 to 1.15 chromium, 0.15 to 0.25 molybdenum, no greater than 0.035 phosphorous, no greater than 0.04 sulfur and balance iron. The above composition is characteristic of an AISI 4140 steel. In yet another preferred embodiment, the infiltration metal is an alloy steel, having a composition by weight percent comprising 0.25 to 0.32 carbon, 0.50 to 0.90 manganese, 1.40 to 1.80 silicon, 1.60 to 2.00 chromium, no greater than 0.50 nickel, 0.30 to 0.40 molybdenum, no greater than 0.035 phosphorous, no greater than 0.04 sulphur, no greater than 0.15 copper, no greater than 0.03 aluminum, no greater than 0.02 vanadium, 0.025 to 0.04 zirconium, and balance iron.

Desirably, the infiltration metal has a melting temperature at least equal to or greater than the melting temperature of the metal base, and preferably, a melting temperature at least equal to or greater than that of the base metal. The infiltrating metal melting temperature being equal to br greater than that of the base metal causes the weld formation at the interface which is critical to obtaining a high bond strength. However, it should be noted that one skilled in the art may employ dissimilar metals for the infiltration and base metals, as long as the fusion bond integrity is not detrimentally affected.

In the preferred embodiment, the infiltration metal is fusion bonded to the base metal by the formation of a weld between the two metals at the interface, called the fusion interface. A fusion bond is the preferred method of attachment in order for the resultant metal matrix composite to withstand the rigorous wear and impact duty application, such as for example, a ground engaging tool.

In the preferred embodiment of the present invention, the preform, prior to being infiltrated by the infiltration metal, desirably has a total porosity in the range of about 40% to about 60% out of which, the interconnecting porosity is desirably at least 90% of total porosity, and preferably, at least 98% of the total porosity. A total porosity less than 40% is undesirable because there will not be enough infiltrant metal phase to obtain a high impact resistance. A total porosity greater than 60% is undesirable because there will not be enough reinforcement preform material to obtain a high wear resistance. A porosity in the range of about 40% and about 60% represents a compromise between the desired wear resistance and impact resistance of the metal matrix composite. An interconnecting porosity less than 90% of total porosity is undesirable because it will detrimentally result in insufficient infiltration of the preform by the infiltration metal, thus reducing wear and impact resistance.

In the preferred embodiment of the present invention, the preform, after being infiltrated by the infiltration metal, has a final porosity desirably no greater than 2% and preferably, no greater than 0.5%. A final porosity greater than 2% is undesirable because it will reduce the strength and impact resistance of the metal matrix composite component.

According to the preferred embodiment, the process of the present invention is used to make a ground engaging tool, such as a bucket edge for a dozer, having a cast-in-place abrasion and impact resistant metal matrix composite component, as shown in Example A.

EXAMPLE A

The base metal selected is an AISI 1527 steel having the following composition by weight:

| | |
|---|---|
| carbon | 0.22% to 0.29% |
| manganese | 1.20% to 1.50% |
| phosphorous | 0.04% max. |
| sulphur | 0.05% max. |
| iron | balance. |

The infiltration metal selected is an AISI 4140 steel having the following composition by weight:

| | |
|---|---|
| carbon | 0.36% to 0.44% |
| manganese | 0.70% to 1.00% |
| silicon | 0.15% to 0.30% |
| chromium | 0.80% to 1.15% |
| molybdenum | 0.15% to 0.25% |
| phosphorous | 0.035% max. |
| sulphur | 0.04% max. |
| iron | balance. |

The material for the preform is aluminum oxide in a particulate form. The alumina particles have a mesh size in the range of about 20 to 30.

The steel alloy for making the metallic base component of the ground engaging element is placed within a first mold, which has heating elements on the side walls and cooling elements at the bottom. The first mold is preheated to a temperature of about 2642° F. The first mold temperature is maintained during this preheating stage in the range of about 2630° F. to about 2650° F. A second mold, also having heating elements, is placed on the top of the first mold and the two molds are held together by clamping means. Alumina particles are poured into the cavity created by the combination of the first and second molds.

A filter pad made from materials such as alumina is placed on the top of the alumina particles. The filter pad has a porosity in the range of about 25% to 85%. The infiltrating metal is then placed on the top of the filter. The second mold is preheated to a temperature of about 2825° F. The second mold temperature is maintained during this heating stage in the range of about 2775° F to about 2875° F. The infiltration metal, i.e., AISI 4140 steel in this example, is melted and becomes the infiltration charge. A vacuum of about 600 mm Hg is maintained in the alumina preform via a tube as shown earlier in FIG. 1. The entire apparatus is placed in a pressure vessel and pressurized to a pressure of about 1500 psig. The molten steel alloy infiltrates the alumina preform and causes local melt formation of the alloy steel of the base component. A fusion bonding of the infiltrant metal and the base metal occurs with accompanying physical and mechanical interlocking of the alumina preform in the melt at the interface.

Industrial Applicability

The present invention is particularly useful to the construction, mining and earthworking equipment industry for making ground engaging elements for abrasion and impact duty applications. In typical abrasion duty applications, both penetration and wear resistance are required, such as for dozing clay, loam, silt, sand, and gravel. In typical impact duty applications, more fracture strength is required, such as for dozing blasted rock, slabs and boulders in a mining environment.

The process of this invention is particularly useful for making impact and wear resistant components for tools such as a profiler shank and cutting edges for various earthworking machines such as motor graders, dozers, excavator buckets, wheel loader buckets, front shovel buckets and scrapers. Other applications include dozer end bits and compacter feet, including chopper blades and plus tips for landfill applications. Yet other applications include bucket tips for wheel loaders, dozers, excavators, front shovels and backhoe loader buckets.

Other aspects, objects and advantages of this invention can be obtained from a study of the drawings, the disclosure and the appended claims.

I claim:

1. A process for pressure infiltration casting of a metal matrix composite in a metallic article, comprising the steps of:

selecting a base metal for forming a metallic base component, said base metal having a melting temperature;

forming said metallic base component having a shape of preslected dimensions and an exterior surface of a preselected configuration, at least a portion of said exterior surface of said metallic base component being adapted for mating with a corresponding exterior surface of a preform;

selecting a material for forming said preform, said material being selected from one of ceramics, cermets, or mixtures thereof;

forming said preform having an exterior surface of a preselected configuration, at least a portion of said exterior surface of said preform being adapted for mating with said corresponding exterior surface of said metallic base, and said preform having interconnecting porosity;

selecting an infiltration metal for forming a molten infiltrant charge, said infiltration metal having a melting temperature at least equal to or greater than the melting temperature of said base metal;

providing a first mold having a first mold cavity including said metallic base component;

preheating said first mold and said metallic base component to a temperature in the range of about (x−200)°F. to about (x−50)°F., wherein x is said melting temperature of said base metal;

providing a second mold having a second mold cavity including said preform and said infiltration metal;

positioning said second mold adjacent said first mold and mating a portion of said exterior surface of said preform with a corresponding exterior surface of said metallic base and forming an interface;

heating said second mold, said preform and said infiltration metal to a temperature in the range of about (y−200)°F. to about (y+200)°F., wherein y is said melting temperature of said infiltration metal, and forming a preheated preform and said molten infiltrant charge;

evacuating said preform and isolating a vacuum in said preform;

pressurizing said molten infiltrant charge at a pressure sufficient for infiltrating said molten charge into said interconnecting porosity of said preform and forming an infiltrated preform;

contacting said molten infiltration charge with said preheated base metal at said interface;

melting at portion of said base metal at said interface, fusion-bonding said infiltration metal with said base metal at said interface, and forming a fusion bond interface; and cooling said metallic base and causing directional solidification of said infiltration metal from said fusion bond interface to said exterior surface of said preform.

2. A process, as set forth in claim 1, wherein base metal is one of cast iron or alloy steel.

3. A process, as set forth in claim 2, wherein said base metal is an alloy steel.

4. A process, as set forth in claim 3, wherein said alloy steel has a composition by weight %, comprising, 0.22 to 0.29 carbon, 1.20 to 1.50 manganese, no greater than 0.04 phospherous, no greater than 0.05 sulphur, and balance iron.

5. A process, as set forth in claim 3, wherein said alloy steel has a composition by weight %, comprising, 0.36 to 0.44 carbon, 0.70 to 1.00 manganese, 0.15 to 0.30 silicon, 0.80 to 1.15 chromium, 0.15 to 0.25 molybdenum, no greater than 0.035 phosphorous, no greater than 0.04 sulphur, and balance iron.

6. A process, as set forth in claim 1, wherein said preform is made of one of porous pack, particulates, tubules, platelets, pellets, spheres, fibers, woven mat, whiskers and mixtures thereof.

7. A process, as set, forth in claim 1, wherein said ceramic material is at least one ceramic material selected from the group consisting of titanium carbide, aluminum oxide, titanium diboride and tungsten carbide.

8. A process, as set forth in claim 7, wherein said ceramic material is aluminum oxide.

9. A process, as set forth in claim 1, wherein said cermet material is at least one cermet material formed from (a) ceramic materials, selected from the group consisting of silicon carbide, titanium carbide, chromium carbide, titanium diboride and tungsten carbide, and (b) metallic materials selected from the group consisting of molybdenum, tungsten, cobalt, chromium, niobium and tantalum or mixtures thereof.

10. A process, as set forth in claim 1, wherein said preform, prior to being infiltrated by said infiltration metal, has a total porosity in the range of about 40% to about 60%, the interconnecting porosity being at least 90% of the total porosity.

11. A process, as set forth in claim 10, wherein said interconnecting porosity is at least 98% of the total porosity.

12. A process, as set forth in claim 1, wherein said in filtration metal is at least one of molybdenum, tungsten, chromium, niobium, tantalum, iron, alloy steel or mixtures thereof.

13. A process, as set forth in claim 12, wherein said infiltration metal is in alloy steel.

14. A process, as set forth in claim 13, wherein said alloy steel has a composition by weight %, comprising, 0.36 to 0.44 carbon, 0.70 to 1.00 manganese, 0.15 to 0.30 silicon, 0.80 to 1.15 chromium, 0.15 to 0.25 molybdenum, no greater,than 0.035 phosphorous, no greater than 0.04 sulphur, and balance iron.

15. A process, as set forth in claim 13, wherein said alloy steel has a composition by weight %, comprising, 0.25 to 0.32 carbon, 0.50 to 0.90 manganese, 1.40 to 1.80 silicon, 1.60 to 2.00 chromium, no greater than 0.50 nickel, 0.30 to 0.40 molybdenum, no greater than 0.035 phosphorous, no greater than 0.04 sulphur, no greater than 0.15 copper, no greater than 0.03 aluminum, no greater than 0.02 vanadium, 0.025 to 0.04 zirconium, and balance iron.

16. A process, as set forth in claim 1, wherein said first mold is preheated to a temperature in the range of about (x−100)°F. to about (x−50)°F.

17. A process, as set forth in claim 1, wherein said second mold is heated to a temperature in the range of about (y)°F. to about (+100)°F.

18. A process, as set forth in claim 1, wherein said preform is evacuated to a vacuum in the range of about 500 mm Hg to about 700 mm Hg.

19. A process, as set forth in claim 1, wherein said molten infiltrant charge is pressurized to a pressure in the range of about 1000 psig to about 10,000 psig.

20. A process, as set forth in claim 1, wherein said base metal is AISI 1527 alloy steel, said infiltration metal is AISl 4140 alloy steel, said preform is alumia particulates having a particle size in the range of about 20 mesh to about 30 mesh, said molten infiltrant charge is pressurized to a pressure of about 1500 psig, said first mold is preheated to a temperature in the range of about 2630° F. to about 2550° F., and said second mold is heated to a temperature in the range of about 2775° F. to about 2875° F.

* * * * *

UNITED STATES PATENT AND TRADEMARK OFFICE

CERTIFICATE OF CORRECTION

PATENT NO. : 5,664,616

DATED : September 9, 1997

INVENTOR(S) : Gerald A. Gegel

It is certified that error appears in the above-identified patent and that said Letters Patent is hereby corrected as shown below:

Column 9, line 47, delete "," after the word "materials"

Column 10, line 19, delete "," after the word "greater" leaving a blank space between the words "greater" and "than"

Column 10, line 35, delete "(+100)" and insert -- (y+100) --

Column 10, line 48, delete "2550" and insert -- 2650 --

Signed and Sealed this

Twenty-fourth Day of February, 1998

*Attest:*

Bruce Lehman

BRUCE LEHMAN

*Attesting Officer*

*Commissioner of Patents and Trademarks*